US005889645A

United States Patent [19]

Kadah et al.

[11] Patent Number: 5,889,645

[45] Date of Patent: Mar. 30, 1999

[54] ENERGY PRESERVATION AND TRANSFER MECHANISM

[75] Inventors: Andrew S. Kadah, Manlius, N.Y.; Andrew M. Nguyen, El Cajon, Calif.

[73] Assignee: International Controls and Measurement Corp, Cicero, N.Y.

[21] Appl. No.: 838,884

[22] Filed: Apr. 14, 1997

[51] Int. Cl.[6] ..... H01H 47/00

[52] U.S. Cl. ..... 361/191; 361/156; 361/155; 361/166; 361/167; 361/195; 307/141; 307/139

[58] Field of Search ..... 361/155, 156, 361/166, 167, 191, 195; 307/139, 141

[56] References Cited

U.S. PATENT DOCUMENTS

| | | | |
|---|---|---|---|
| 3,812,382 | 5/1974 | Pascente | 307/133 |
| 4,215,383 | 7/1980 | Boyd et al. | 361/210 |
| 4,327,693 | 5/1982 | Busser | 123/490 |
| 4,600,966 | 7/1986 | Mueller et al. | 361/166 |
| 4,862,866 | 9/1989 | Calfus | 123/490 |
| 4,865,538 | 9/1989 | Scheele et al. | 431/18 |
| 4,950,974 | 8/1990 | Pagano | 323/222 |
| 5,074,780 | 12/1991 | Erdman | 431/24 |
| 5,085,574 | 2/1992 | Wilson | 431/6 |
| 5,523,632 | 6/1996 | Serognoli | 307/125 |

*Primary Examiner*—Jeffrey A. Gaffin
*Assistant Examiner*—Kim N. Huynh
*Attorney, Agent, or Firm*—Trapani & Molldrem

[57] ABSTRACT

An arrangement for driving actuator coils for two or more driven devices employs a microprocessor or similar controller and an actuator driver circuit. The actuator driver circuit controls two or more relay actuator coils from a single microprocessor output terminal. This output terminal can provide a high, low, or pulse output signal. An amplifier switching device, such as a transistor, whose base is coupled to the output terminal of the microprocessor, drives the first relay actuator coil as its load. A rectifying diode is connected to one end of a capacitor and thence through a negative resistance device to a second relay actuator coil or other driven device. The coil impedances are selected so that the second coil has a significantly higher impedance than the first coil. When output pulses appear at the microprocessor output terminal, the transistor switch pulses on and off, and thus energizes the first coil. Flyback voltage pulses pass through the rectifier diode to charge up the capacitor until its voltage exceeds the threshold voltage of the negative resistance device. Then current flows to energize the second relay actuator coil. By selecting the appropriate pulse rate, the microprocessor can energize either or both actuator coils.

14 Claims, 2 Drawing Sheets

CHARACTERISTIC OF NEGATIVE RESISTANCE DEVICE 50

ENERGY PRESERVATION AND TRANSFER MECHANISM

BACKGROUND OF THE INVENTION

The present invention relates to energy preservation and transfer mechanisms, and to such mechanisms incorporated into control circuits, e.g., furnace controls. The invention is more specifically concerned with a control circuit with a gas valve relay driver circuit which will actuate a gas valve when all driver components are in proper order, but will fail to actuate the gas valve otherwise. The invention is also concerned with a circuit that actuates two or more devices, e.g., an inducer blower motor and a gas valve, from a single controller output.

In a modern gas furnace, one or more gas burners inject a gas flame through a heat exchanger, and the combustion gases are drawn through the heat exchanger by means of an inducer blower, which exhausts the combustion gases to a vent or flue. A pressure sensor associated with the inducer actuates a pressure switch to indicate a pressure differential between the exhaust and intake of the inducer. The pressure switch provides assurance that the inducer is functioning properly.

An indoor air blower forces air from a comfort zone past the heat exchanger to draw heat from the combustion gases. The warmed air is then returned to the comfort zone. A temperature limit switch on the heat exchanger is normally closed, and opens if the heat exchanger exceeds a predetermined temperature. This limit switch serves as a check on proper air flow and functioning of the indoor air blower.

A thermostat located in the comfort zone closes when the room temperature drops below a predetermined setpoint, and thereby signals a call for heat. When a call for heat is detected, control and timing circuitry for the furnace actuates the inducer blower and then initiates an actuation sequence which energizes a gas valve relay so that current is supplied to a gas valve. This allows combustion gas to flow to the bumers. At this time, igniters are actuated to light the burners, and the furnace begins to produce heat. An infrared detector, rectification or other mechanism is employed to ensure that there is flame after the gas valve is actuated. If no flame is present, another series switch interrupts the thermostat power and turns off the gas valve. Also, a rollback switch detects if flame is not entering the heat exchanger but is instead proceeding in the combustion air intake direction.

After the burners have been ignited for a predetermined time, the room air blower is powered up, and this creates a flow of warm air to the interior comfort zone.

Conventionally, 24 volt ac thermostat power is supplied through the series arrangement of the limit switch, thermostat, pressure switch, gas valve relay, and gas valve. Optionally, a pilot relay can actuate a line-powered gas valve relay.

As aforementioned, the limit switch, thermostat, and pressure switch are all disposed in series with the gas valve relay, so that no current can flow through the gas valve relay to actuate the gas valve, until the limit switch and pressure switch are both closed. This serves as a check that the room air blower and the inducer blower are functioning properly.

A safety problem can arise if any of the limit switch, pressure switch, or gas valve relay are for some reason locked into a closed condition. In those cases, the gas valve will continue to feed gas to the burners if the heat exchanger experiences overtemperature, or if the inducer fails to produce sufficient draft.

In a modem furnace control unit, such as is shown in Erdman U.S. Pat. No. 5,074,780, a microprocessor circuit has a multiplicity of inputs connected respectively to the series switches, with a separate microprocessor input coupled to the junction between each switch and the next successive switch or operating element. This means that, for each switch, the microprocessor requires a separate input circuit. As the cost of the microprocessor depends on the number of input circuits that are needed, the cost of the control circuit can become great. Also, a failure of any one of the input circuits can prevent the device from detecting a switch malfunction or failure condition. In addition, for each actuator device, that is, for each of the gas valve, the inducer blower, the room air blower, etc., the microprocessor requires a separate output. Again, the need for multiple output terminals further drives the cost of the microprocessor upwards.

Generally, whenever there is a call for heat, the controller should be able to check the conditions of the pressure switch and the gas valve relay before supplying current to the coil for the gas valve relay. This permits the control circuit to check for switch malfinction and indicate a service condition, if service or repair is required. In the conventional system, each switch has a connection to an associated input. As each switch goes from an open to a closed condition, the respective microprocessor input circuit goes from a low to a high level. Thus when there is a call for heat, the input circuit associated with the thermostat goes to a high, and the microprocessor then is alerted to turn on the inducer blower. This pressure switch closes after the inducer creates a pressure differential, and the associated microprocessor input goes from low to high. Then the gas valve relay is actuated, and the microprocessor input associated with the gas valve relay goes from low to high. This arrangement permits a positive check that the pressure switch and gas valve relay can both open and close.

The gas valve relay has an actuator coil with a driver circuit that is controlled by an output of the microprocessor. The gas valve relay driver circuit is typically designed so that if any of the driver components fail, the gas valve will not turn on. That is, the gas valve driver circuit must be constructed in such a way that the gas valve will not be turned on inadvertently. Clearly, this safety feature is necessary to keep the room space around the furnace from flooding with unignited gas, as that could present a danger of either suffocation or explosion.

One fail-safe gas valve driver circuit has been described in U.S. Pat. No. 5,085,574, granted Feb. 4, 1992, to Larry E. Wilson. In that arrangement, the driver circuit comprises a transistor or similar switching device with a collector load resistor coupled to a voltage source, the actuator coil for the gas valve relay, a capacitor tied in series between the collector of the transistor and the actuator coil, and a diode in parallel to the actuator coil. The furnace controller emits pulsating dc to the transistor to actuate the coil. The capacitor blocks straight dc from actuating the coil. If there is a failure in any of these driver components either in the nature of an open or a short, the circuit will deny current through the actuator coil, and the gas valve relay will fail to close. While this circuit is rather simple and straightforward, it does have a few drawbacks. For one, the capacitor is disposed on the coil side of the transistor, so the capacitor must be capable of absorbing large amounts of current. Therefore, a large and costly electrolytic capacitor is used, typically 50 $\mu$f. Because of the high levels of current needed for the actuator coil, the pulsating dc produces a significant ripple on the capacitor. This shortens the life of the capacitor, causing frequent failures of the capacitor component. Likewise, high currents also appear across the diode, which can cause diode failure.

The system of the Wilson patent is also blind to the actual switch condition of the gas valve relay, and does not prevent gas valve actuation in the event that the gas valve or the gas valve relay contactor is frozen into a closed condition. Moreover, the microprocessor in the Wilson patent requires separate discrete output terminals for each relay actuator to be controlled, and this raises the complexity and cost of the microprocessor Further, at the output side, the actuation of the gas valve relay is not directly tied to the integrity of the blower motor relay or its driver circuit. Unfortunately, actuation of the gas valve when the inducer is inoperative or not actuated can lead to fire, explosion, or suffocation.

In these relay and actuator based arrangements, the flyback energy from the release of the inductor is considered to be an undesirable consequence of inductive switching. These arrangements routinely include a flyback diode in inverse parallel with the coilto attenuate the flyback energy. No one in this art has considered using the flyback energy for any useful purpose.

In Andrew Kadah patent application Ser. No. 08/629,167, filed Apr. 8, 1996, and in Andrew Kadah et al. U.S. patent application Ser. No. 08/622,266, filed Mar. 27, 1996, a controller circuit is described in which multiple input devices, e.g., switches, are interrogated at a single microprocessor input terminal. The microprocessor can interrogate the switch condition of each of the switches based on the presence or absence of a predetermined frequency at that single input. In particular, as each switch goes from an open to a closed condition, a variable oscillator circuit associated with the switches changes its output frequency or pulse rate. The variable oscillator output is applied to a single input terminal of the microprocessor. The rate of the variable oscillator output varies as a function of the closed or open condition of the switch elements. The microprocessor is programmed to sense the various switch conditions based on the rate of the input signal at the appropriate times as applied to the microprocessor input terminal. By using a single input terminal to monitor the switch condition of several switch elements, the microprocessor can be made more economically and more reliable.

Nevertheless, even with the reduced number of inputs as achieved in these earlier patent applications, separate discrete output terminals are required for each respective function. That is, the microprocessor requires separate output terminals for the inducer relay and the gas valve relay. It has not been possible previously to reduce the number of microprocessor output terminals needed for a given number of driven devices. In addition, second order failure mode protection has been elusive for these devices.

OBJECTS AND SUMMARY OF THE INVENTION

It is an object of this invention to provide a second-order fail-safe drive system for a gas valve or other device which will prevent gas valve actuation if there is a component failure.

It is another object to provide a controller arrangement which employs fewer component parts and is more rugged than arrangements of the prior art.

It is a further object of the invention to utilize flyback voltage for controlling and/or energizing further elements.

It is a more specific object to provide a controller arrangement in which the number of controller output terminals can be reduced for a given number of driven elements.

According to an aspect of this invention, a controller arrangement is arranged to actuate two or more actuator devices from a single output of a control element. Typically, this is a microprocessor device, but the arrangement could be based on a multivibrator circuit, a PUT based circuit, or a logic circuit used in place of the microprocessor.

The control element has an input terminal and an output terminal, with the output terminal providing a signal which is high, low, or intermittent depending on an input signal applied at said microprocessor input terminal. A switch device having a control input coupled to the output terminal of said microprocessor control element, a first current carrying electrode connected to a current sink, and a second current carrying electrode. For example, this can be a junction transistor, with the base connected to the output terminal, and the emitter connected to the current sink. A first relay actuator coil actuates one of the driven devices, for example, the inducer blower, and has a first end connected to a voltage supply and a second end connected to the second current carrying electrode of the switch device, e.g., to the collector electrode of the junction transistor. A first capacitor has a first terminal connected to the first end of the first relay actuator coil, and a second terminal. A one-way current conducting device, e.g., a rectifier or diode, has a first electrode, e.g., its anode, connected to the second electrode of the first relay actuator coil and a second electrode, e.g., its cathode, connected to the second terminal of the first capacitor. A second relay actuator coil actuates a second one of the driven devices, for example, the gas valve relay. The second relay actuator coil has a first end connected to the first terminal of capacitor and a second end. A negative resistance device, such as a diac, tunnel diode, or other appropriate device, has a first end connected to the second terminal of the first capacitor and a second end connected to the second end of the second relay actuator coil. The impedance of the second relay actuator coil is higher than the impedance of the first relay actuator coil.

This invention takes advantage of the fact that the second actuator coil requires a relatively high closing voltage to close its associated contact, but thereafter only a relatively low holding voltage to maintain the contact closed. The negative resistance device has a high positive impedance until the second terminal of said first capacitor is charged to a threshold voltage, and then drops to a low impedance when that threshold is reached. The device is selected to have a threshold somewhat higher than the closing voltage. Thus when output pulses (e:g. at about 1 KHz to 10 KHz) appear at the microprocessor output terminal, the first switching device drives the first actuator coil to actuate the associated driven device (such as the inducer blower). Current alternately flows and is cut off at the second end of the first actuator coil. The flyback voltage at this point passes through the diode or rectifier to the capacitor. This gradually charges the second terminal of the capacitor to a positive voltage. When the capacitor charges up to the threshold voltage of the negative resistance device, the device permits the charge on the capacitor to pass as actuating current to the second actuator coil thus to close the second actuator coil's associated relay contact. After closure, current continues to pass at a lower voltage through the negative resistance device. This continuing current is sufficient to maintain closure.

This arrangement can actuate the first actuator coil alone by applying pulses at a relatively low rate (e.g., dc to several hundred Hz) from the microprocessor output terminal. At this low rate, the charge on the capacitor will dissipate before it reaches the threshold voltage, and the second actuator will not be energized. Then, by applying pulses at the appropriate rate, both the first and second actuator coils will be energized to actuate their respective driven devices. On the other hand, if pulses at a high rate (e.g., several hundred KHz) appear at the microprocessor output terminal, the pulse rate can be too high to energize the first actuator coil on account of its high reactance at that pulse rate, but will be sufficient to provide current to charge up the capacitor to reach the above-mentioned threshold voltage. Thus, by selecting the appropriate output pulse rate, the microprocessor or other control element can energize either or both of the actuator coils from its single output terminal.

In another embodiment, there can be an additional diode, an additional capacitor, an additional negative resistance device, and a third actuator coil connected to the second actuator coil. By selection of pulse rate at the microprocessor output terminal, this arrangement can actuate any combination of the first, second, or third actuator coils.

If there is a failure of any of these components, such as the transistor switch, the first relay actuator coil, the diode, the capacitor, or the negative resistance device, the actuator coil for the gas valve relay will fail-safe. That is, if there is a failure of any of these components, or of more than one of them, there will be no current or insufficient current provided to the second (i.e. gas valve relay) actuator coil, and the relay contacts will not close.

The invention is not limited to arrangements in which the second driven device is a relay or actuator coil. Rather, the second device can be any powered device, where the first relay actuator coil, the diode, the capacitor and the negative resistance device serve as a power supply for the powered device. This powered device could be, for example, a second logic circuit. The second logic circuit could monitor the condition of the primary output driver (supplying the first actuator coil), or could itself become operational from the flyback energy of the primary actuator coil.

The above and many other objects, features, and advantages of this invention will present themselves to persons skilled in the art from the ensuing detailed description of a preferred embodiment of the invention, when read in conjunction with the accompanying Drawing.

DETAILED DESCRIPTION OF THE PREFERRED EMBODIMENT

Figure 1:
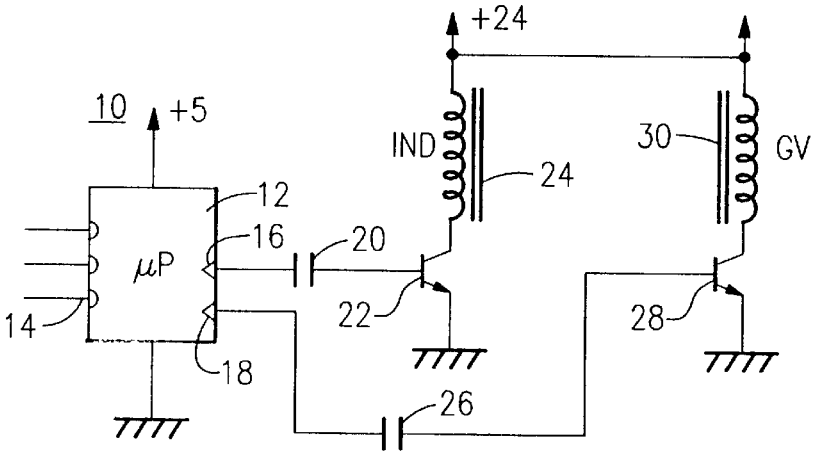
FIG.1 Prior Art
FIG. 1 is a block diagram of a microprocessor-based control circuit of an earlier design.

With reference to the Drawing, FIG. 1 schematically illustrates a control arrangement 10 of the type generally described in co-pending U.S. patent application Ser. Nos. 08/629,167 and 08/622,266, mentioned above, for a gas furnace or similar equipment. The disclosure contained therein is incorporated herein by reference.

As shown, the control arrangement is based on a microprocessor control 12 that has a plurality of input terminals 14 and at least a first output terminal 16 and a second output terminal 18. In practice, there are at least as many output terminals as there are devices to be controlled. The microprocessor also has power leads connected to suitable voltage points, e.g., +5 volts and ground. The output terminal 16 is coupled by a capacitor 20 to the base of a switching transistor 22. A relay actuator coil 24 for a driven device, e.g., the furnace inducer motor, has one lead connected to a source of +24 volts dc and a second lead connected to the collector of the transistor 22. The emitter of this transistor 22 is tied to a current sink, e.g., chassis ground. The second microprocessor output terminal 18 is coupled through a capacitor 26 to the base of a second switching transistor 28. A second relay actuator coil 30, e.g., for the furnace gas valve relay, has one lead connected to the source of +24 volts and a second lead connected to the collector of the switch transistor 28, whose emitter is grounded. As explained in the above mentioned U.S. Pat. Ser. Nos. 08/629,167 and 08/622,266, the actuator coils 24 and 30 are energized when pulses at a suitable repetition frequency appear at the respective output terminals 16 and 18, but are unenergized if there is a dc high or low voltage appearing at the microprocessor output terminals. This does provide the control arrangement with significant advantages over the prior art, e.g., as typified in the Wilson patent. However, a potential problem arises from the fact that the two coils, that is, the inducer relay actuator coil 24 and the gas valve relay actuator coil 30, are separately and independently actuated. With this arrangement, it is possible to energize the gas valve relay 30 under some conditions when there is a failure of either the transistor 22 or the inducer actuator coil 24. Also, with this arrangement 10, the microprocessor 12 requires separate respective output terminals 16 and 18; as discussed above, the cost of the microprocessor depends on the number of input and output terminals that have to be provided.

Figure 2:
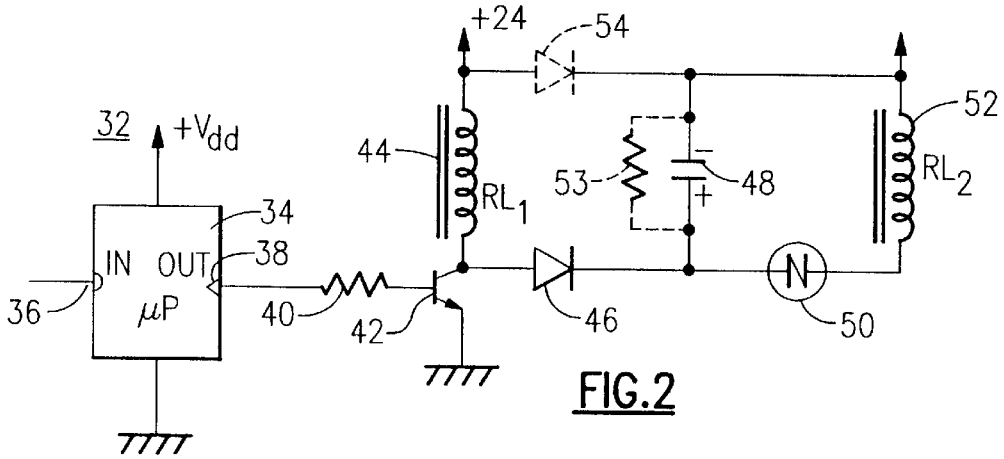
FIG. 2 is a block diagram of a control circuit according to an embodiment of the invention.

A control circuit 32 according to one embodiment of the present invention is shown in FIG. 2. Here the microprocessor 34 is shown with a single input terminal 36 and a single output terminal 38. As discussed above, the microprocessor can be programmed to be sensitive to input pulses at predetermined rates appearing at the input terminal 36. This is accomplished, e.g., as described in copending applications Ser. Nos. 08/629,167 and 08/622,266. A coupling resistor 40 connects the microprocessor output terminal 38 to the base of an NPN switching transistor 42, whose emitter is grounded and whose collector is connected to one end of a relay actuator coil 44. The other end of the coil 44 is connected to a source of +24 volts dc. Alternatively, a dc blocking capacitor can be used in lieu of the resistor 40 for ac coupling to the transistor 42. A rectifying diode 46 has its anode connected to the junction of the transistor collector and the coil 44. A capacitor 48 has one side connected to a source and the other side connected to the cathode of the rectifying diode 46. A negative resistance device 50 has one end connected to the junction of the diode 46 with the capacitor 48, and another side connected to one end of a second relay actuator coil 52, whose other end is connected to the voltage source. An optional blocking diode 54 can be interposed between the first coil 44 and the capacitor 48. The impedance of the second actuator coil 52 is higher than the impedance of the first coil 44. Each of the two actuator coils has a hysteresis factor, that is, a higher applied voltage $V_{close}$ is required to close the respective contacts than the voltage $V_{hold}$ that is required to maintain the contacts closed thereafter. Here, the second relay actuator coil 52 can have typical values of pickup or closing voltage $V_{close}$ and holding voltage $V_{hold}$ of 16 volts and 4 volts, respectively. Also, in one example of a typical arrangement, the first actuator coil 44 can have an impedance of 100 ohms and the second actuator coil can have an impedance of 1.5 K. The capacitor 48 can have a value of 10 microfarads, for example. These values can be varied widely.

Figure 3:
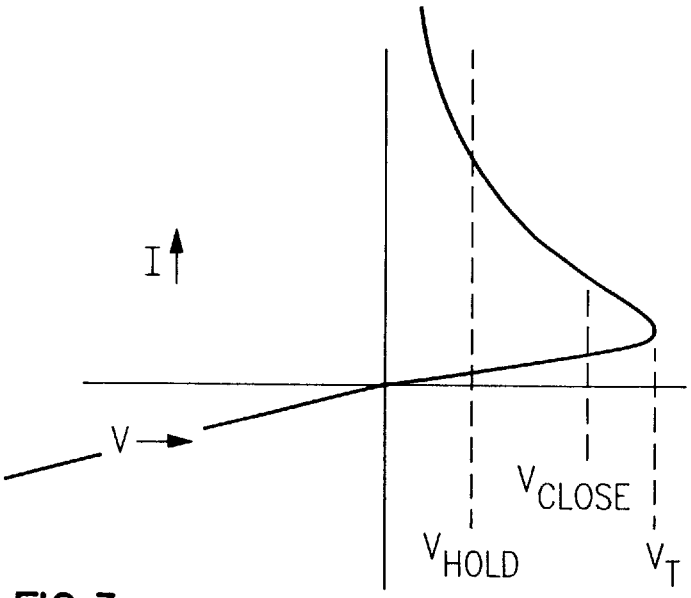
FIG. 3 is a chart explaining the characteristic of a negative resistance device as employed in this embodiment.

The negative resistance device 50 can be a diac, silicon bilateral switch, silicon unilateral switch, tunnel diode, neon lamp, or any other device having the appropriate negative resistance characteristic for this application. Here, the typical negative resistance device has the voltage-current characteristic as generally shown in FIG. 3. For a region from zero voltage up to a threshold voltage $V_T$, the device 50 exhibits a high positive resistance and permits a flow of only a modest amount of current. However, the characteristic has a knee defined at the voltage $V_T$, and when the applied voltage reaches this point, the device 50 exhibits a region of negative resistance, where the current through the device 50 increases with a drop in voltage across the device. This negative resistance region continues to a minimum voltage. Here, the device 50 is selected so that the threshold voltage $V_T$ is somewhat higher than the closing voltage $V_{close}$, e.g., 18 volts, and the minimum voltage is somewhat below the holding voltage $V_{hold}$, e.g., 2–3 volts. This arrangement permits the capacitor 48 to charge up its lower side to a voltage that is positive, i.e., higher than the +24 volts that appears on its upper side. An optional bleed resistor 53 can be disposed in shunt with the capacitor 48.

Figure 4:
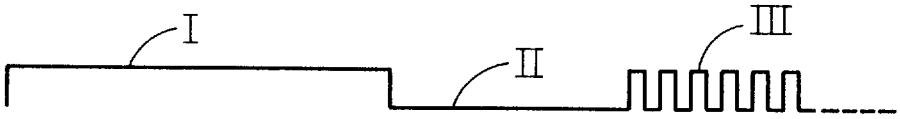
FIG. 4 shows a pulse output signal for explaining the operation of this embodiment.

The operation of this circuit arrangement can be explained with reference to the wave chart of FIG. 4. The inducer motor can be turned on initially to test for operability before proceeding further. To accomplish this, the microprocessor 34 produces a low frequency (dc to about 100 Hz) (I) at the output 38. This turns the transistor 42 on, so current flows through the actuator coil 44. The coil 44 closes its associated contacts and powers up the inducer blower motor. The inducer operation can then be monitored by means of the pressure switch. The gas valve relay contacts, associated with the actuator coil 52, are monitored to ensure that the contacts are not fused closed. Then the microprocessor 34 produces a low output (II) at the terminal 38, to bias the transistor 42 off. This removes the current from the coil 44, and de-energizes the associated inducer blower motor. The inducer operation is again monitored, to ensure that the transistor switch 42 is not fused and that the actuator coil 44 is not locked on. The relay contacts associated with the gas valve relay actuator 52 are also monitored. A dc signal first turns the actuator 44 coil on, and then the microprocessor applies a pulse signal (IMI) at a suitable pulse repetition frequency, e.g., 1000 Hz to 10 KHz, and at a duty cycle of about 50%. This drives the transistor 42 on and off alternately, so that pulsating dc passes through the coil 44. This closes the inducer relay contacts to energize the inducer blower. The current is alternately flowing and halting through the coil 44. The coil inductance produces a flyback voltage when the transistor 42 shuts off. This action pumps current spikes through the diode 46 and the resulting charge accumulates on the capacitor 48. The voltage on the capacitor rises, and after a number of cycles the capacitor voltage exceeds the threshold voltage $V_T$ of the negative resistance device 50. When this happens, the capacitor discharges through the second actuator coil 52 at a voltage in excess of the closing or pickup voltage $V_{close}$. Thereafter, the current produced by the flyback voltage continues to flow through the diode 46 and device 50 into the coil 52 at a lower level that is sufficient to hold the relay contacts closed.

If any one or more of the diode 46, capacitor 48, gas valve actuator coil 52 or negative resistance device 50 fails, the controller arrangement will not produce the pickup voltage $V_{close}$ for the actuator coil 52 to actuate the relay contacts. Discontinuing the pulse signal (III) at the microprocessor output 38 will de-energize both the actuator coils 44 and 52.

Figure 5:
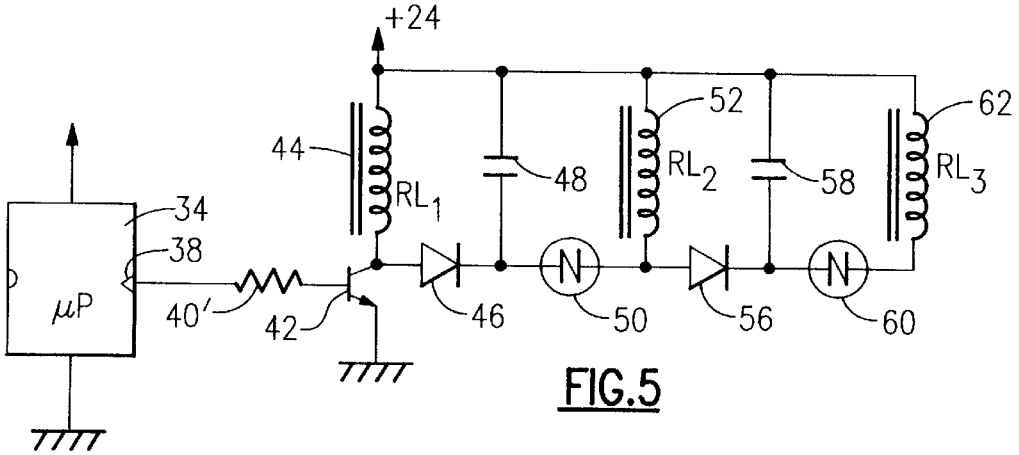
FIG. 5 is a block diagram of another embodiment of the invention, adapted for controlling three of more driven devices.
Figure 6:
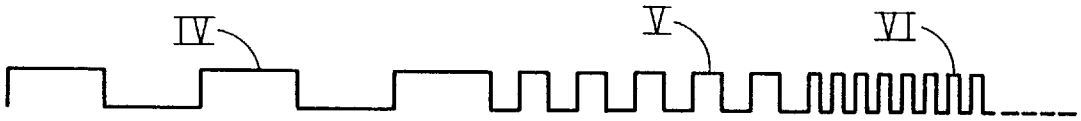
FIG. 6 shows a pulse output signal for explaining the operation of this embodiment.

Another possible embodiment is shown in FIG. 5, in which the same elements are identified with similar reference numbers, and for which a detailed description need not be repeated. In this embodiment, the first and second relay actuator coils 44 and 52 are connected as described above, with the switching transistor 42 having a dc blocking capacitor 40' connected between the output terminal 38 and the base of the transistor 42. However, there is additionally a third diode 56 having its anode connected to the junction of the second actuator coil 52 and the negative resistance device 50, a second capacitor 58 having one end connected to the cathode of the diode 56 and its other end connected to the upper end of the second actuator coil 52. A second negative resistance device 60 has one end connected to the junction of the diode 56 and the capacitor 58, and a third relay actuator coil 62 has one end connected to the negative resistance device and its other end connected to the upper end of the capacitor 58 and relay actuator coil 52. Here, the operation with respect to the first and second actuator coils 44 and 52 is similar to that described above in respect to the first embodiment. If the microprocessor 34 applies low frequency pulse signals, i.e., as in pulse signal (IV) in FIG. 6, the first relay actuator coil receives actuating current and closes its associated contacts. However, the pulse rate is too low to actuate the second or third coils 52, 62. At a somewhat higher pulse rate, pulse signal (V), e.g. 10 KHz, will permit the controller arrangement 32 to energize both actuator coils 44 and 52. Then, at a further elevated pulse rate, e.g., as shown at (VI), which can be 20 KHz, the flyback pulses pass also through the diode 56 and charge up the capacitor 58 until the threshold voltage of the device 60 is exceeded. This causes the third coil 62 to pick up and latch its associated relay contacts. At a pulse rate significantly higher than this, the reactance of the first actuator coil 44 inhibits sufficient current flow, and the first coil 44 is unable to close its contacts. Nevertheless, the pulsations are able to energize the second and third actuator coils 52 and 62, while the first actuator relay contacts remain unactuated. By careful selection of the actuator coils for impedance, pickup voltage and holding voltage, and by careful selection of the values of the capacitors 48 and 58 and of the threshold voltages for the negative resistance devices 50 and 60, the control arrangement 32 can be designed to actuate any one of the three relay actuator coils, or any combination thereof. In addition, it is possible to add stages for relay actuators beyond the third coil 62, and which would function in a manner similar to that described just above. Also, as mentioned above, other control elements besides microprocessors could be employed, and other powered devices besides actuator coils could serve as the driven elements. Furthermore, the principles of this invention are not limited to furnace control arrangements.

As an alternative to the arrangement as shown in FIG. 5, a combination circuit could be configured with the anode of the diode 56 connected at the cathode of the diode 46, rather than having the diac 50 interposed between the two stages. Other possible arrangements with three or more stages can also be constructed for any of various applications.

While the invention has been described here with reference to several preferred embodiments, it should be recognized that the invention is not limited to those precise embodiments. Rather, many modifications and variations will present themselves to persons skilled in the art without departing from the scope and spirit of this invention, as defined in the appended claims.

We claim:

1. Arrangement for actuating two or more actuator devices from a single microprocessor output, comprising a microprocessor control element having an input terminal and an output terminal, said output terminal providing a signal which is high, low, or intermittent depending on an input signal applied at said microprocessor input terminal;

a switch device having a control input coupled to the output terminal of said microprocessor control element, a first current carrying electrode connected to a current sink, and a second current carrying electrode;

a first relay actuator coil for actuating one of said devices, and having a first end connected to a voltage supply and a second end connected to the second current carrying electrode of said switch device;

a first capacitor having a first terminal connected to the first end of said first relay actuator coil, and a second terminal;

a one-way current conducting device having a first electrode connected to the second electrode of said first relay actuator coil and a second electrode connected to the second terminal of said first capacitor;

a second relay actuator coil for actuating a second one of said devices, and having a first end connected to the first terminal of said capacitor and a second end; and a negative resistance device having a first end connected to the second terminal of said first capacitor and a second end connected to the second end of said second relay actuator coil.

2. The arrangement of claim 1 wherein said first relay actuator coil and said second relay actuator coil have first and second impedances respectively, and said second impedance is higher than said first impedance.

3. The arrangement of claim 1 wherein said one-way current conducting device is a diode biased to pass flyback current from the first actuator coil to the second end of said first capacitor.

4. The arrangement of claim 1 wherein said negative resistance device has a high positive impedance until the second terminal of said first capacitor is charged to a threshold voltage, and drops to a low impedance when said threshold is reached, thereby permitting charge on said capacitor to pass as actuating current through said negative resistance device and said second actuator coil.

5. The arrangement of claim 1 wherein said second actuator coil requires a closing voltage to actuate its associated contact closed, and a holding voltage to maintain said contact closed once actuated, said holding voltage being significantly lower than said closing voltage.

6. Arrangement for actuating three or more actuator devices from a single microprocessor output, comprising a microprocessor control element having an input terminal and an output terminal, said output terminal providing a signal which is high, low, or intermittent depending on an input signal applied at said microprocessor input terminal;

a switch device having a control input coupled to the output terminal of said microprocessor control element, a first current carrying electrode connected to a current sink, and a second current carrying electrode;

a first relay actuator coil for actuating one of said devices, and having a first end connected to a voltage supply and a second end connected to the second current carrying electrode of said switch device;

a first capacitor having a first terminal connected to the first end of said first relay actuator coil, and a second terminal;

a first one-way current conducting device having a first electrode connected to the second electrode of said first relay actuator coil and a second electrode connected to the second terminal of said first capacitor;

a second relay actuator coil for actuating a second one of said devices, and having a first end connected to the first terminal of said capacitor and a second end;

a first negative resistance device having a first end connected to the second terminal of said first capacitor and a second end connected to the second end of said second relay actuator coil;

a second capacitor having a first terminal connected to the first end of said second relay actuator coil, and a second terminal;

a second one-way current conducting device having a first electrode connected to the second electrode of said second relay actuator coil and a second electrode connected to the second terminal of said second capacitor;

a third relay actuator coil for actuating a third one of said devices, and having a first end connected to the first terminal of said second capacitor and a second end; and a second negative resistance device having a first end connected to the second terminal of said first capacitor and a second end connected to the second end of said second relay actuator coil.

7. Arrangement for actuating two or more actuator devices from a single output of a control element, comprising a control element having an input terminal and an output terminal, said output terminal providing a signal which is high, low, or intermittent depending on an input signal applied at said control element input terminal;

a switch device having a control input coupled to the output terminal of said control element, a first current carrying electrode connected to a current sink, and a second current carrying electrode;

a first relay actuator coil for actuating one of said devices, and having a first end connected to a voltage supply and a second end connected to the second current carrying electrode of said switch device;

a first capacitor having a first terminal connected to the first end of said first relay actuator coil, and a second terminal;

a one-way current conducting device having a first electrode connected to the second electrode of said first relay actuator coil and a second electrode connected to the second terminal of said first capacitor;

a second relay actuator coil for actuating a second one of said devices, and having a first end connected to the first terminal of said capacitor and a second end; and a negative resistance device having a first end connected to the second terminal of said first capacitor and a second end connected to the second end of said second relay actuator coil.

8. The arrangement of claim 7 wherein said first relay actuator coil and said second relay actuator coil have first and second impedances respectively, and said second impedance is higher than said first impedance.

9. The arrangement of claim 7 wherein said one-way current conducting device is a diode biased to pass flyback current from the first actuator coil to the second end of said first capacitor.

10. The arrangement of claim 7 wherein said negative resistance device has a high positive impedance until the second terminal of said first capacitor is charged to a threshold voltage, and drops to a low impedance when said threshold is reached, thereby permitting charge on said capacitor to pass as actuating current through said negative resistance device and said second actuator coil.

11. The arrangement of claim 7 wherein said second actuator coil requires a closing voltage to actuate its associated contact closed, and a holding voltage to maintain said contact closed once actuated, said holding voltage being significantly lower than said closing voltage.

12. Arrangement for actuating one or more actuator devices and another powered device from a single output of a control element, comprising a control element having an input terminal and an output terminal, said output terminal providing a signal which is high, low, or intermittent depending on an input signal applied at said control element input terminal;

a switch device having a control input coupled to the output terminal of said control element, a first current carrying electrode connected to a current sink, and a second current carrying electrode;

a first relay actuator coil for actuating one of said devices, and having a first end connected to a voltage supply and a second end connected to the second current carrying electrode of said switch device;

a first capacitor having a first terminal connected to the first end of said first relay actuator coil, and a second terminal;

a one-way current conducting device having a first electrode connected to the second electrode of said first relay actuator coil and a second electrode connected to the second terminal of said first capacitor;

a powered device having a first end connected to the first terminal of said capacitor and a second end; and a negative resistance device having a first end connected to the second terminal of said first capacitor and a second end connected to the second end of said powered device.

13. The arrangement of claim 12 wherein said one-way current conducting device is a diode biased to pass flyback current from the first actuator coil to the second end of said first capacitor.

14. The arrangement of claim 1 wherein said negative resistance device has a high positive impedance until the second terminal of said first capacitor is charged to a threshold voltage, and drops to a low impedance when said threshold is reached, thereby permitting charge on said capacitor to pass as actuating current through said negative resistance device and said powered device.

* * * * *